United States Patent [19]

Pareja

[11] 4,199,305

[45] Apr. 22, 1980

[54] HYDRAULIC GEROTOR MOTOR WITH BALANCING GROOVES AND SEAL PRESSURE RELIEF

[75] Inventor: Ramon Pareja, Minneapolis, Minn.

[73] Assignee: Lear Siegler, Inc., Santa Monica, Calif.

[21] Appl. No.: 35,628

[22] Filed: May 3, 1979

Related U.S. Application Data

[63] Continuation of Ser. No. 841,663, Oct. 13, 1977, abandoned.

[51] Int. Cl.[2] ..... F04B 49/02; F01C 1/10; F01C 21/00; F03C 3/00

[52] U.S. Cl. ..... 417/440; 418/75; 418/102; 418/171

[58] Field of Search ..... 418/71, 75, 79, 102, 418/166, 170, 171; 417/440

[56] References Cited

U.S. PATENT DOCUMENTS

| | | | |
|---|---|---|---|
| 1,307,602 | 6/1916 | Schirmer | 417/440 |
| 1,793,577 | 2/1931 | Wilsey | 418/75 |
| 2,082,265 | 6/1937 | Smith | 417/440 |
| 2,105,428 | 1/1938 | Maglott | 418/206 |
| 2,433,360 | 12/1947 | Haight | 418/102 |
| 3,120,190 | 2/1964 | Schmitter et al. | 418/191 |
| 3,213,799 | 10/1965 | Trick | 418/132 |
| 3,289,601 | 12/1966 | Compton | 418/61 B |
| 3,427,983 | 2/1969 | Brundage | 418/171 |
| 3,433,168 | 3/1969 | Banker | 418/206 |
| 3,574,489 | 4/1971 | Pierrat | 418/171 |
| 3,583,839 | 6/1971 | Brundage | 418/171 |
| 3,680,989 | 8/1972 | Brundage | 418/171 |
| 3,834,842 | 9/1974 | Dorff et al. | 418/171 |
| 3,905,728 | 9/1975 | Swedberg | 418/61 B |
| 3,907,465 | 9/1975 | Dorff et al. | 418/171 |
| 3,910,732 | 10/1975 | Lusztig | 418/61 B |
| 3,981,641 | 9/1976 | D'Amato | 418/102 |
| 4,057,222 | 11/1977 | Lyle | 418/171 |

*Primary Examiner*—John J. Vrablik

*Attorney, Agent, or Firm*—Orrin M. Haugen; Thomas J. Nikolai

[57] ABSTRACT

A hydraulic motor of the Gerotor-type which is designed for rotation in both the clockwise and the counterclockwise direction and which includes a pair of relief valves arranged to protect the motor shaft seal, irrespective of the chosen direction of rotation. The Gerotor element also includes a pair of motoring grooves which cooperate with a feed channel formed in the surface of the motor end plate and with a corresponding shadow feed channel on the opposite motor front plate to equalize the forces on the rotor element of the Gerotor and thereby prevent distortion and binding of the rotor element due to thrust forces thereon. Similarly, to prevent excessive forces on the end of the motor shaft, a relief groove is provided between the normal low pressure outlet port and the bearing chamber in the end plate, such that the hydraulic force acting on the end of the shaft tending to urge it in the axial direction is no greater than the product of the cross-sectional area of the shaft and the pressure maintained at the low pressure side of the motor.

1 Claim, 6 Drawing Figures

HYDRAULIC GEROTOR MOTOR WITH BALANCING GROOVES AND SEAL PRESSURE RELIEF

This is a continuation of application Ser. No. 841,663, filed Oct. 13, 1977, now abandoned.

BACKGROUND OF THE INVENTION

I. Field of the Invention

This invention relates generally to the design of a hydraulic motor and more specifically to a Gerotor hydraulic motor in which provision is made for controlling the pressure exerted on the shaft and shaft seals as well as upon the rotor element of the Gerotor assembly.

II. Description of the Prior Art

Gerotor hydraulic motors, per se, are well known in the art. In this arrangement an inner gear is keyed to, and rotates with, the shaft to be driven. An outer gear of the internal type is driven by the hydraulic fluid introduced through timing crescents formed in the adjacent end and front plates and is free to rotate with a snug fit in a stator which forms a part of the housing. The inner gear has a lesser number of teeth than is provided in the outer gear and the teeth of the two gears are specially shaped so that the top of all teeth of the inner gear are always in sliding contact with the teeth of the outer gear.

In accordance with the present invention, the Gerotor elements are sandwiched between an end plate and a front plate and one end of the shaft is journaled for rotation in the end plate while the other end of the shaft is journaled in suitable bearings in the front plate. A shaft seal is disposed in the front plate in proximity to the front plate bearings to prevent the leakage of hydraulic fluid along the shaft and past the front shaft bearings.

Hydraulic fluid, under high pressure, for example, 2,000 PSI may be made to selectively flow through a first or a second port formed in the endplate which communicates with the crescents abutting the Gerotor elements. The remaining port communicates with the low pressure side of the Gerotor element. In known prior art arrangements, motors of the Gerotor type are only designed to produce unidirectional shaft rotation, either clockwise or counter clockwise, but not both. The motor design of the present invention, however, allows a reversal in the direction of rotation by simply controlling the flow of the high pressure hydraulic fluid to the inlet/outlet ports, while still providing pressure relief to the shaft seal. Also, to accommodate bidirectional rotation of the shaft, first and second motoring grooves are provided between the stator element of the Gerotor and the internal toothed outer gear. These motoring grooves cooperate with motoring groove feed channels formed in the motor front plate and with corresponding shadow feed channels formed in the end plate. As such, axial thrust forces which would otherwise exist on the faces of the inner and outer gear elements of the Gerotor assembly are balanced, irrespective of the direction of rotation of the outer gear with respect to the stator.

Also in the preferred embodiment of the present invention, means are provided to relieve the high pressure which would exist on the end of the motor shaft tending to displace it outwardly if this relief structure were not provided.

The Banker U.S. Pat. No. 3,433,168 discloses the use of a pressure relief valve in combination with a gear-type pump such that if the output pressure of the pump is too great, the pressure relief valve will open to permit fluid into the input port. This patent does not disclose the feature of the present invention wherein first and second ball-check type pressure relief valves are disposed in relationship to the bearing end seal to provide pressure relief thereto irrespective of the direction of rotation of the motor shaft. Similarly, the Compton U.S. Pat. No. 3,289,601 discloses in FIG. 7 thereof a Gerotor-type motor/pump having a channel 165 communicating with an annular recess 166 formed in the front plate. This arrangement is designed to provide pressure relief to the bearing seal 118, but it is to be noted that in the Compton patent, such pressure relief only occurs when the high pressure side of the hydraulic system is connected to the input port 49 and the low pressure connection is made to the output port 40. If an attempt were made to reverse the direction of rotation of the motor by interchanging the input/output port connections, no such relief would be available. Similarly, the Compton patent does not include a pressure relief valve in communication with the annular recess 166.

SUMMARY OF THE INVENTION

It is accordingly the principal object of the present invention to provide a Gerotor-type hydraulic motor which is simple in construction and which permits bidirectional rotation of the output shaft through the mere reversal of the normal high pressure and low pressure ports.

The above object of the invention is accomplished by providing first and second pressure relief valves, one of which will always communicate with the low pressure side of the hydraulic system, irrespective of the direction of rotation of the output shaft adopted. These pressure relief valves will ensure that only modest hydraulic force is exerted on the shaft seals, thereby greatly extending their life. Furthermore, first and second motoring grooves are provided in the stator element of the Gerotor and are axially disposed on either side of the gear position defining the conventional separated fluid-tight pockets or chambers of the Gerotor assembly. These motoring grooves, then, provide for equalization of forces on the faces of the Gerotor elements, irrespective of the direction of rotation that the inner gear and outer gear assume.

Also in accordance with the teachings of the present invention, the end plate has a channel or groove provided on the internal face thereof which communicates between the shaft bore therein and the normal, low pressure output port and ensures that the hydraulic force acting in the axial direction on the end of the motor shaft will not be excessive, at least when the motor is caused to rotate in a first direction.

These and other features and advantages of the invention will become apparent to those skilled in the art upon a reading of the following detailed description of the preferred embodiment, especially when considered in light of the accompanying drawings in which:

DESCRIPTION OF THE PREFERRED EMBODIMENT

Figure 1:
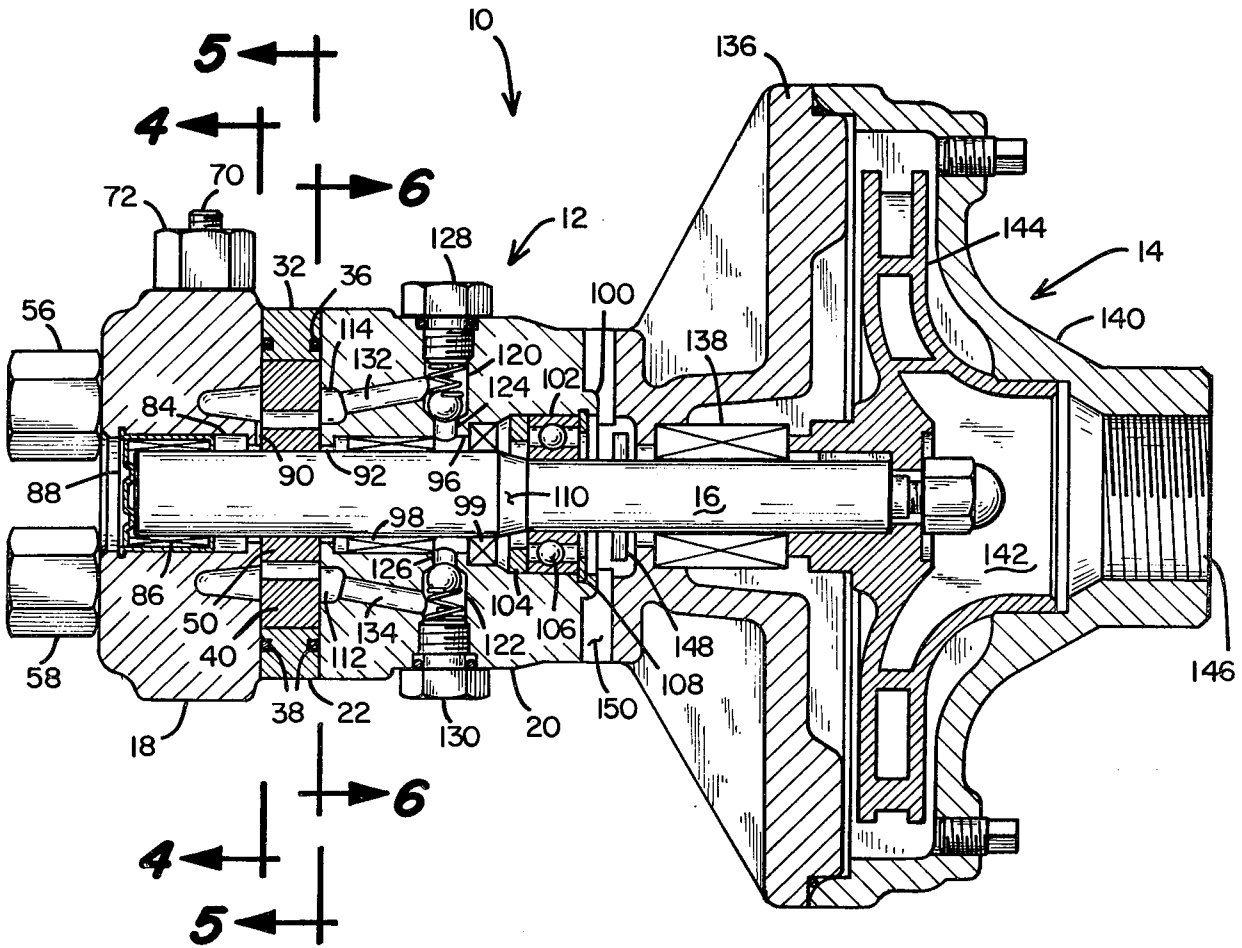
FIG. 1 is a longitudinal, cross-sectional view of a motor driven pump assembly.

Referring first to FIG. 1 there is indicated generally by numeral 10 a hydraulic motor driven centrifugal pump which includes a motor section indicated generally by numeral 12 and a centrifugal pump section indicated generally by numeral 14 which are connected together and mounted on a common shaft 16. While the present invention is principally concerned with the construction of the hydraulic motor 12, it is deemed beneficial to show the physical relationship between the motor and the pump 14 driven thereby.

With respect to the hydraulic motor 12, as can be seen from FIG. 1, it is basically comprised of three sections, namely an end plate 18, a front plate 20 and a Gerotor assembly 22 sandwiched therebetween. The end plate 18, the Gerotor assembly 22 and the front plate 20 are connected together by means of bolts 24 which pass through the aligned holes 26, 28 and 30 formed in the end plate 18, the Gerotor assembly 22 and the front plate 20, respectively.

Figure 5:
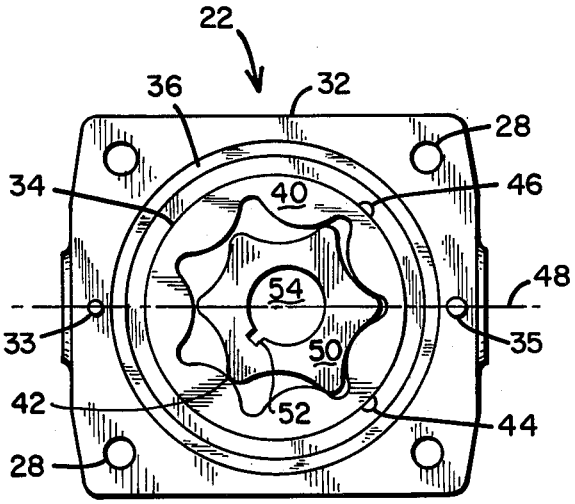
FIG. 5 is a plan view of the Gerotor assembly as observed along the line 5—5 in FIG. 1.

With respect to FIGS. 1 and 5, it can be seen that the Gerotor assembly 22 comprises a stator member 32 having a cylindrical bore 34 formed therethrough. Holes of differing diameter and having dowel pins 33 and 35 press fitted therein are provided, the dowel pins extending outwardly from each face of the stator member 32 to provide registration between the mating surfaces of the end plate 18 and the front plate 20. Formed on opposing faces of the stator 32 are annular grooves 36 in which are disposed O-rings made from a suitable resilient material to form a tight, fluid retaining seal between the mating surfaces of the end plate 18 and the front plate 20. Contained within the cylindrical bore 34 of the stator element 32 is an outer gear 40 having a plurality of internal teeth 42. The diameter of the outer gear 40 is slightly less than the diameter of the bore 34 so that the gear element 40 may rotate freely therein. First and second motoring grooves 44 and 46 are formed axially on the inner surface of the cylindrical bore 34 and are disposed at equal angles on either side of the center line 48 of the cylindrical bore 34.

Contained within the opening defined by the teeth formed in the outer gear 40 is an inner gear 50 which is adapted to be secured to the shaft 16 by means of a key (not shown) which fits into the notch 52 which is contiguous with the bore 54 through which the shaft 16 passes.

It is to be noted that the internal gear 50 has one less tooth than does the outer gear 40. It may also be seen from FIG. 5 that the teeth of the gears 40 and 50 are rounded and they operate on the well-known Gerotor principle, with the teeth on the respective gears sealingly engaging one another to define fluid-type pockets between the gears.

Figure 2:
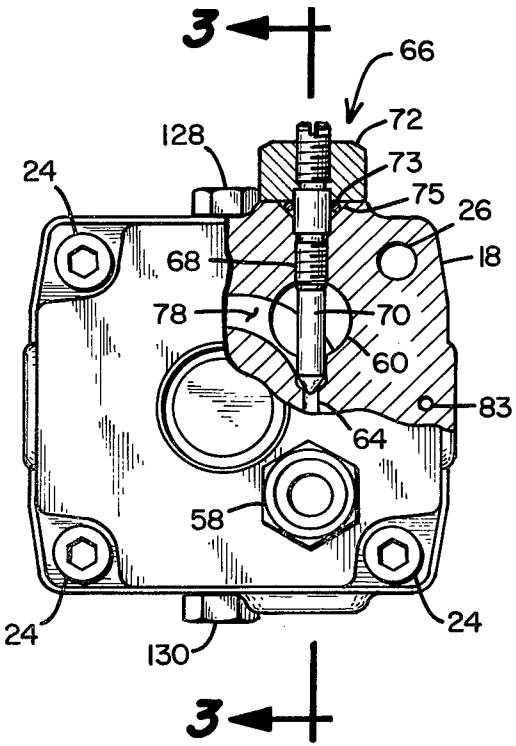
FIG. 2 is an end view of the motor assembly of FIG. 1, partially broken away to reveal certain internal features thereof.
Figure 3:
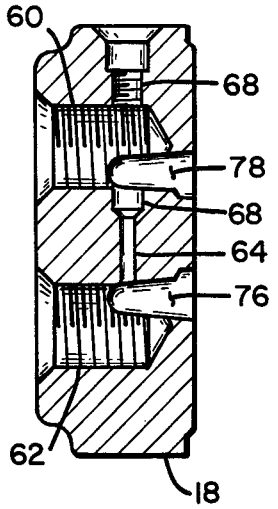
FIG. 3 is a cross-sectional view taken along the line 3—3 in FIG. 2.

The configuration of the end plate 18 will next be described by reference to FIGS. 1–4. First and second hose fittings 56 and 58 are threadedly inserted in tapped bores 60 and 62 formed in the end plate 18. In the explanation which will follow the detailed description of the construction of the preferred embodiment, it will be assumed that fitting 58 is adapted to be connected to the high pressure side of a source of hydraulic fluid and that fitting 56 is adapted to be connected to the low pressure side of the hydraulic fluid source. However, in accordance with the principles of the present invention, the direction of rotation of the shaft 16 may be reversed by a simple reversal of the inlet and outlet connections 58 and 56. With particular reference to FIGS. 2 and 3, it can be seen that there is also drilled or otherwise formed in the end plate 18 a bore 64 which passes between the threaded ports 60 and 62. A needle valve assembly, indicated generally by numeral 66 is disposed in another bore 68 formed in the end plate 18 and the valve stem portion 70 can be screwed inward and outward in a blocking and unblocking relationship with the bore 64 in a conventional fashion. An O-ring seal 73 is disposed in a tapered notch and cooperates with a smooth cylindrical portion 75 of the needle valve stem to prevent leakage during adjustment of the valve opening. A locking nut 72 may be employed to maintain a desired setting of the needle valve stem 70 with respect to the bore 64.

Milled, cast, or otherwise formed on the inner face 74 of the end plate 18 are first and second crescent-shaped grooves 76 and 78. The crescent groove 76 communicates with the inlet/outlet port 62 while the crescent groove 78 communicates with the input/output port 60. Also formed in the face 74 of the end plate 18 are first and second motoring groove feed channels 80 and 82. The channel 80 abuts and communicates with the crescent groove 75 while the channel 82 abuts and communicates with the crescent groove 78. By observing the disposition of the feed channels 80 and 82 in FIG. 4 with respect to the motoring grooves 44 and 46 in FIG. 5, it can be seen that when the end plate 18 and the Gerotor assembly 22 are positioned in their abutting relationship as indicated in FIG. 1, that the motoring grooves 44 and 46 will be aligned with the motoring groove feed channels 80 and 82 respectively. The dowel pins 33 and 35 set into the Gerotor stator 32 fit into the holes 83 and 85 to maintain proper registration and since the dowel pins and mating holes in the end plate are of differing diameter, one-way orientation only is allowed such that during assembly the feed groove channels 80 and 82 will always be aligned with the motoring grooves 44 and 46.

Again referring to the cross-sectional view of FIG. 1, there can be seen in the end plate 18 a central bore 84 in which is disposed a needle bearing assembly 86 which rotatably supports the end of the shaft 16. A snap ring 88 may conveniently be used to hold the bearing assembly 86 in place in the end plate 18. A narrow relief groove 90 is formed in the face 74 of the end plate 18 and communicates between the shaft bore 84 and the crescent groove 78. As will become more apparent when the operation of the device is described, the relief groove 90 provides a means whereby the axial thrust acting on the shaft 16 is reduced.

Consideration will now be given to the construction of the front plate assembly 20. In this regard, FIGS. 1 and 6 will be referred to. The front plate 20 comprises a generally rectangular housing having an axial bore 92 formed in the face 94 thereof. The bore 92 extends for a predetermined distance where it engages a concentric bore 96 of larger diameter and disposed within the bore 96 is a needle bearing assembly 98 which rotatably supports the shaft 16 within the front plate 20.

The bore 96 through the housing forming the front plate 20 also engages an adjacent bore of somewhat larger diameter in which is disposed a seal 99. Formed in the front surface 100 of the front plate 20 is a concentric bore 102 having a diameter which is greater than the diameter of the bore in which the seal member 99 is fitted. Disposed in this bore 102 is a spacer ring 104 and a ball bearing assembly 106 which is held in place by means of a snap-type retainer ring 108. The ball bearing assembly 106 supports the front end of the shaft 16 and is designed to withstand relatively high axial thrust forces imparted to it by the tapered shoulder 110 of the shaft 16.

Figure 6:
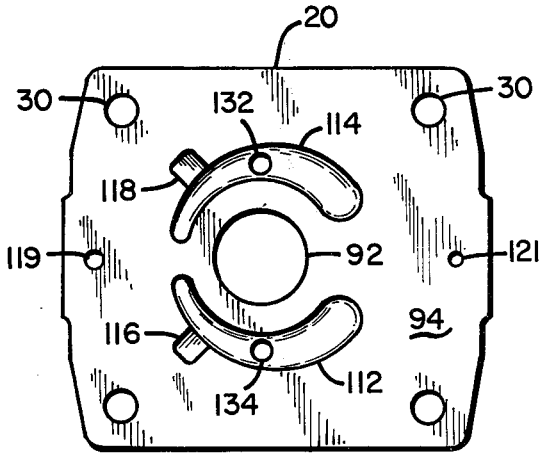
FIG. 6 is a plan view of the front plate portion of the motor of FIG. 1 taken along the line 6—6.

Referring to FIG. 6, there is illustrated the configuration of the crescent groove 112 and 114 formed in the face 94 of the front plate 20. Also formed within the face 94 of the front plate 20 and communicating with their respective crescent grooves 112 and 114 are motoring groove feed channel shadow recesses 116 and 118. By referring to FIGS. 4 and 6, it can be seen that when the face 74 of the end plate 18 and the face 94 of the front plate 20 are juxtaposed against opposed surfaces of the Gerotor assembly 22 that the crescent 76 will be substantially aligned with the crescent 112 and the crescent 78 will be aligned with the crescent 114. Similarly, the motoring groove feed channels 80 and 82 formed in the end plate will be in alignment with the corresponding motoring groove feed channel shadow recesses 116 and 118 formed in the face of the front plate 20. Proper registration of the parts is insured by the dowel pins 33 and 35 cooperating with the holes 83–85 in the end plate and holes 119 and 121 in the front plate.

Referring again to FIG. 1, it can be seen that radially extending bores 120 and 122 are formed in the housing and extend from the outer surface thereof inwardly on opposite sides of the shaft 16. The bores 120 and 122 each terminate in a concentric bore of lesser diameter indicated by numerals 124 and 126 respectively. Screwed into the bore 120 is a ball-check relief valve 128 and the bore 122 contains a similar ball-check relief valve assembly 130. These two ball-check valve's assembly are identical in construction and include a spherical element which is normally held in a seating engagement with the bores 124 and 126 by means of conical springs. Communicating between the bore 120 and the crescent groove 114 is a bore 132. Similarly, a bore 134 connects the crescent groove 112 to the bore 122.

While specifically not forming a part of the instant invention, there is shown in FIG. 1 a centrifugal pump head 14 which comprises a mounting plate 136 which is bolted to the end surface 100 of the motor front plate 20. The shaft 16 passes through a hole formed in the plate 136 and a seal 138 surrounds the shaft to preclude the fluid being handled by the pump 14 from flowing back into the ball bearing assembly 106 of the motor and possibly contaminating same. A cover plate 140 is fastened to the mounting plate 136 to define a chamber 142 in which is located an impeller element 144. The impeller 144 is attached to the shaft 16 and is therefore driven thereby. The fluid material to be pumped enters through the threaded opening 146 in the cover plate 140, and is engaged by the impeller and forced out of the pump outlet (not shown). A slinger ring 148 is attached to the shaft 16 and is disposed in a recess formed in the mounting plate 136 in an area between the seal 138 and the bearing assembly 106 of the motor unit 12. Thus, any fluid which may find its way past the seal 138 will be engaged by the slinger ring 148 and thrown radially out of the slot 150, thus aiding further in protecting the motor bearings 106 from contamination.

Now that the details of the construction of the preferred embodiment have been set forth, consideration will be given to the mode of operation of the device.

OPERATION

In order to drive the shaft 16 in a first direction, hydraulic fluid under high pressure is introduced into the hose connection 58 on the end plate 18 and from there it passes through the port 62 which communicates with the crescent groove 76 (FIG. 4) and with the fluid pockets defined by the spacing between the internal gear 50 with the external gear 40 of the Gerotor assembly 22. This fluid force tends to rotate the outer gear 40 in a clockwise direction and in doing so also rotates the inner gear 50 in accordance with the well-known principles of Gerotor action. The crescent 78 cooperates with the low pressure port 60 which is connected at hose connection 56 back to the low pressure side of the source of hydraulic fluid. The needle valve stem 70 being disposed in a sealing relationship with respect to the bore 64 between the high pressure inlet port and the low pressure outlet port can be used to control the fluid force applied to the Gerotor elements. Specifically, when the valve stem 70 is in its seated position with respect to the bore 64, all of the high pressure hydraulic fluid is directed through the Gerotor gear elements to cause rotation thereof whereas if the needle valve 70 is backed off by a desired amount, a portion of the input fluid will bypass the Gerotor elements and pass directly to the output port 60. The needle valve assembly 70 can then be used to control the rate of rotation of the shaft 16 as well as the output torque delivered to the load.

Because both the inner gear 50 and the outer gear 40 of the Gerotor assembly 22 must be free to rotate within the stator element 32 thereof, a slight clearance must be maintained between the mating side surfaces of these gear elements and the opposing faces 74 and 94 of the end plate and front plate respectively. Because of this slight clearance to allow free rotation of the gear elements, the hydraulic fluid under high pressure is able to leak between these mating surfaces. Hence, high pressure fluid in the crescent 76 may seep between the interface of the inner gear 50 with the end plate 18 and through the needle bearings 86 where it may act upon the cross-sectional area of the end of the shaft 16 to apply an undesired axial thrust to the shaft. To alleviate this problem, a relief groove 90 is provided which communicates with the bore 84 housing the needle bearings 86 and the crescent groove 78 associated with the low pressure side of the hydraulic system. As such, the end of the shaft is only exposed to the low pressure rather than to the relatively high pressure appearing at the inlet port. This substantially reduces the axial thrust imparted to the shaft 16 and prevents undue wear on the shaft and the associated thrust bearings 106.

The high pressure hydraulic fluid present in the crescent gap 112 in the front plate 20 may also seep between the side surface of the inner gear 50 of the Gerotor assembly and its mating face 94 of the front plate 20. This fluid, at a relatively high pressure, may then pass along the shaft 16 through the needle bearing assembly 98 and will act upon the seal 99. In order to protect the seal 90 from inordinately high hydraulic fluid pressures, irrespective of the direction of rotation of the shaft 16, the ball-check valves 128 and 130 are provided. Assuming for the moment that the high pressure line is connected to the inlet fitting 58, as the pressure of the fluid along the shaft 16 increases above the nominal output line pressure the ball of the relief valve 128 will move out of engagement with the bore 124 against the force of the conical spring to expose the volume defined between the cylindrical bore 96 and the shaft 16 to the low pressure connection via the bore 132, the crescent groove 114, the exposed pockets between the Gerotor inner and outer gears, the crescent 78 and the output port 60.

If, on the other hand, the motor is connected to rotate in the counter clockwise direction and the high pressure line is connected to the coupling 56 while the low pressure is connected to the coupling 58, then the ball-check valve 130 will come into play to provide pressure relief to the seal 99. Specifically, the high pressure fluid in the volume defined by the bore 96 and the shaft 16 will operate upon the ball element of the check valve 130 and urge it out of its seated engagement with the bore 122 to expose the above volume to the low pressure port by way of bore 134, crescent 112, the pockets formed between the inner and outer gear elements of the Gerotor assembly 22, the crescent groove 76 and the low pressure output port 58. Thus, irrespective of the direction of rotation of the shaft, either the check valve 128 or the check valve 130 will provide the desired relief to the seal member 99, thereby greatly extending its useful life and decreasing the frequency of repair of the unit.

Figure 4:
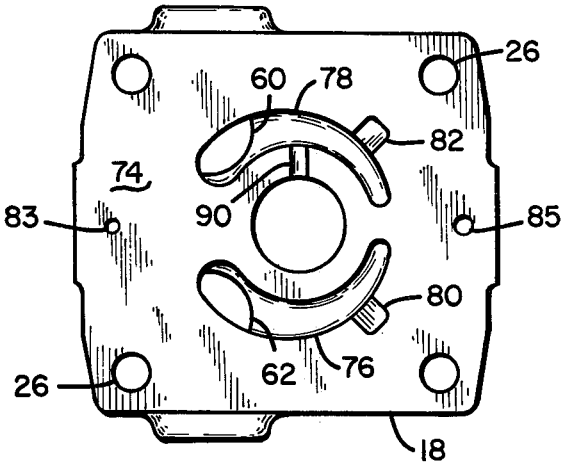
FIG. 4 is a plan view of the face of the end plate as observed along line 4—4 in FIG. 1.

Attention is next directed to FIGS. 4, 5 and 6, especially to the provision of the motoring grooves 44 and 46 in the stator 32 of the Gerotor assembly 22 and to the mating motoring groove feed channels 80 and 82 in the end plate 18 and the motoring groove feed channel shadow recesses 116 and 118 in the face 94 of the front plate 20. Again, assuming that the high pressure hydraulic fluid is applied to the inlet 58, the fluid will pass through the bore 62 into the crescent 76 and into the motoring groove feed channel 80. The fluid will, accordingly, pass through the motoring groove 44 and into the motoring groove feed shadow 116 associated with the crescent 112 formed in the face 94 of the front plate 20. Thus, it can be seen that the hydraulic forces acting on opposite sides of the gear 40 will be equalized, thereby eliminating thrust forces which would otherwise exist if such a motoring groove were not provided. The fluid passing through the motoring groove 44 also serves to lubricate the interface between the stator 32 and the rotating outer gear 40.

Similarly, if the motor of the present invention is connected to operate in the reverse direction by connecting the high pressure side of the source of hydraulic fluid to the port 56 rather than to the port 58, then the high pressure fluid passes through the inlet port 60 into the crescent 78 and through the motoring groove feed channel 82 and the motoring groove 46 into the motoring groove feed channel shadow 118 associated with the crescent 114 in the front plate 20. Again, by providing the axial motoring groove 46 the hydraulic pressures existing on each side of the Gerotor ring 40 will be equalized and no net axial force tending to move the shaft 16 to the right will be imparted. Again, the hydraulic fluid, which is generally a lubricating oil, passing through the motoring groove 46 provides lubrication to the mating surfaces of the Gerotor outer gear 40 and the stator 32.

The structural materials for the motor described herein may include those conventionally utilized, such as cast iron or cast aluminum. The Gerotor assembly including the stator, the outer gear and the inner gear may be formed from cold rolled steel, aluminum or other metal commonly used for this purpose. The needle bearing assemblies 86, 98 and the ball bearing assembly 106 are all commercially available and are selected based upon the diameter of the shaft 16 and the expected axial thrust forces which are expected to be encountered.

While there has been shown and described the preferred embodiment of the invention and the best mode thereof which I have contemplated, it will be obvious to those skilled in the art that the invention may be modified by various substitutions and equivalents and that this disclosure is intended to be illustrative only. The true scope of the invention is to be determined from the accompanying claims.

What is claimed is:

1. A hydraulic motor comprising:

(a) an end plate having a cylindrical axial bore, a fluid inlet port and a fluid outlet port formed therein, each of said ports individually communicating with first and second crescent-shaped grooves formed in one face of said end plate and with each other by way of a by-pass bore;

(b) a needle valve threadedly mounted in said end plate and cooperating with said by-pass bore for permitting selective blocking and unblocking of said by-pass bore;

(c) a shaft having one end thereof journaled for rotation in said cylindrical axial bore in said end plate;

(d) a Gerotor assembly abutting said one face of said end plate and including a stator ring having a cylindrical bore with two axial grooves extending inwardly from said bore and arcuately spaced from one another, said stator ring being secured to said end plate, an outer gear of the internal tooth type having a cylindrical outer peripheral surface which is rotatable within said cylindrical bore of said stator ring, and an inner gear secured to said shaft, said inner gear being eccentrically disposed within said outer gear and having a lesser number of teeth than said outer gear, the tops of all teeth of said inner gear being shaped to always be in sliding contact with the teeth of said outer gear;

(e) a front plate having one face thereof abutting said Gerotor assembly and secured to said stator ring and having an axial bore extending therethrough for receiving said shaft in rotational engagement therein, said one face of said front plate having first and second crescent-shaped grooves therein in substantial alignment with said crescent-shaped grooves formed in said one face of said end plate and with predetermined segments of the interface between said inner and said outer gears of said Gerotor assembly;

(f) a seal member surrounding said shaft and disposed within said axial bore in said front plate;

(g) first and second radial bores in said front plate extending from said axial bore in said front plate to the outer surface of said front plate;

(h) first and second channels individually formed between said first and second radial bores and said first and second crescent-shaped grooves formed in said one face of said front plate; and (i) first and second pressure relief valves disposed in said first and second radial bores in a normal fluid blocking relationship between said axial bore in said front plate and said first and second channels, the arrangement being such that upon closure of said by-pass bore by said needle valve if the fluid pressure acting on said seal member exceeds a predetermined value one of said first and second pressure relief valves will assume a fluid passing relationship between said axial bore in said front plate and one of said first and second channels.

* * * * *